United States Patent [19]

Chapman, Jr. et al.

[11] 4,429,603

[45] Feb. 7, 1984

[54] ROTARY ENVELOPE CUTTING METHOD

[75] Inventors: William A. Chapman, Jr., Hubbardston; John J. Crowley, Ware, both of Mass.

[73] Assignee: Westvaco Corporation, New York, N.Y.

[21] Appl. No.: 378,279

[22] Filed: May 14, 1982

Related U.S. Application Data

[62] Division of Ser. No. 198,464, Oct. 20, 1980, abandoned.

[51] Int. Cl.[3] ..... B31B 19/14

[52] U.S. Cl. ..... 83/37; 83/40; 83/303; 83/911

[58] Field of Search ..... 83/37, 40, 48, 300, 83/303, 343–347, 499, 504, 911; 493/229, 230, 237–239

[56] References Cited

U.S. PATENT DOCUMENTS

| | | | |
|---|---|---|---|
| 850,880 | 4/1907 | Dulin | 83/346 X |
| 854,440 | 5/1907 | Swift | 493/229 |
| 1,253,383 | 1/1918 | Huguelet | 493/229 |
| 1,306,499 | 6/1919 | Novick | 83/911 X |
| 1,310,922 | 7/1919 | Novick | 83/911 X |
| 2,381,955 | 8/1945 | Hoffman et al. | 83/911 X |
| 2,696,255 | 12/1954 | Heywood | 83/911 X |
| 3,143,022 | 8/1964 | Anderson | 83/341 |
| 3,272,042 | 9/1966 | Haas | 83/560 X |
| 3,279,290 | 10/1966 | Stemmler | 83/300 X |
| 3,709,077 | 1/1973 | Trogan et al. | 83/345 X |
| 4,077,291 | 3/1978 | Obenshain | 83/499 |
| 4,136,591 | 1/1979 | Helm et al. | 83/911 X |
| 4,269,097 | 5/1981 | Linn | 83/499 X |

*Primary Examiner*—Frank T. Yost

*Attorney, Agent, or Firm*—W. A. Marcontell; R. L. Schmalz

[57] ABSTRACT

A rotary envelope machine blank cutter is provided with laterally adjustable, independent frame units for each meshing set of knife rolls for changing the depth of a side cut into a blank for envelope size and style production changes. The rotational and axial meshing of hard and soft knives respective to a single knife roll set is adjusted without disturbing the roll mount of either knife. Changes in envelope length or style are accommodated by the mechanical capacity to adjust the rotational cut timing between the knife roll sets of a two-set unit and also between respective cutting units of two or more two-set units. As in the case of lateral cut adjustments, knife roll mounts are undisturbed by rotational timing adjustments. Consequently, the machine may be quickly and accurately changed for production runs of any of several envelope style and several sizes respective to each style: all adjustments being made without disturbing the knife profile mesh of any knife set.

7 Claims, 11 Drawing Figures

ROTARY ENVELOPE CUTTING METHOD

This is a division, of application Ser. No. 198,464, filed Oct. 20, 1980 now abandoned.

BACKGROUND OF THE INVENTION

1. Field of the Invention

The present invention relates to rotary web converting machines and more particularly, to rotary cutting devices for paper envelope forming machines.

2. Description of the Prior Art

Business and packet envelopes are formed from a single rectangular sheet of paper wherein the corners have been cut away to leave four peripherially radiating tabs around a rectangular face body. Three of the tabs are folded along perpendicular lines to a flat position adjacent the inside face of the envelope body where they are adhesively secured together to form the envelope pocket. The fourth tab remains unsecured for closing after the envelope contents have been inserted.

In the mass production of such envelopes, the forming corner cuts may be accomplished by means of a batch cutting die or a high speed line series through one or more rotary knives.

By either cutting means, a considerable time and tool investment is required to accommodate all the envelope styles in use and several size permutations of each style.

In the case of batch cutting dies, a different die is required for each size of each style and will cut a stack of approximately 500 blank sheets in a single stroke of a 60 to 90 second press cutting cycle. Style or size changes are implemented by changing the cutting die that is mounted to the cutting press platen. Such die changes require two to four machine hours.

Rotary knives are productively faster, having a production rate in the order of 2000 envelopes per minute but style or size changes require greater machine down time: from eight to sixteen hours. Each rotary cut is executed by a pair of meshing die or knife edges mounted on respective bed rolls. An extremely hard steel die is secured to one roll and a softer steel die is secured to the other. Both dies are arced to the radius of the respective bed roll and correspondingly profiled so that the desired cut profile is sheared from a sheet of paper positioned between the rolls as the two dies close in rolling convergence. Since it is virtually impossible to manually grind two rotatively meshing profiles to the required accuracy, misalignment is accommodated by grinding and mounting the respective dies as well as possible and then non-productively running the machine to operationally lap the two die edges together.

Reference is given to U.S. Pat. No. 3,143,022 for a more complete description of rotary cutting design and operating principles.

Pursuant to the prior art, it was necessary to repeat these complex die mounting and lapping procedures for each envelope style and size change to be effected on a given machine. Consequently, extremely large orders and long production runs of a single style and size were required of rotary machines to achieve a unit cost parity with press die production: notwithstanding that rotary machine operating productivity is considerably greater than batch die cut production.

It was an objective of the present invention, therefore to devise a rotary envelope cutting machine having a rapid style and size change capacity.

Another objective of the invention is to provide a means for changing the style and size of a rotary envelope cut without disturbing the meshing lap of a cooperative rotary knife set.

Another objective of the invention is to teach means for laterally adjusting the lateral cutting depth of a rotary knife set without disturbing the meshing lap between respective knives of the set.

Another objective of the invention is to provide means for micro-adjusting the lap of a rotary knife set to accommodate wear loss without disturbing the original mount position of either knife.

Another objective of the invention is to provide means for selectively adjusting the relative rotational timing of a plurality of rotary cutting knife sets in a production line series without disturbing the meshing lap of a cooperative knife set.

Another objective of the invention is to provide means for selectively adjusting the timing of a lateral cut pair of rotary knife sets relative to another such pair in a production line series without disturbing the meshing lap of any cooperative knife set or the relative timing of respective knife sets within a cooperative pair of knife sets.

Another objective of the invention is to provide means for close order control of small angle relative timing adjustments between two rotary knife sets in a commonly driven pair of knife sets.

Another objective of the invention is to teach a method of rotary envelope cutting whereby a plurality of envelope styles and a reasonable size range within each style may be cut and changed between styles and sizes without disturbing the meshing lap of any of several knife sets.

SUMMARY OF THE INVENTION

These and other objectives of the invention are accomplished by the method of providing a rotary cutting station for each corner cut of an envelope blank profile development. Rotary knife sets respective to the two upper and two lower corner cuts have mirror opposite cutting configurations. In addition, certain elements of all envelopes are standardized as to size and shape. For example, the closure flaps of all envelopes shown by FIGS. 9, 10 and 11 are identical except for width. Consequently, the same knives may be used for all cuts regardless of envelope style and size. Such envelope differences are accommodated by regulating the length and lateral depth of cut. Relative to the envelope of FIG. 9, all cuts are symmetrical but the bottom cuts 3 and 4 are relatively long. Laterally opposite corner cuts of FIG. 10, however, are assymetric relative to the face body of the envelope. Cuts 1 and 3 are laterally much deeper than cuts 2 and 4.

Pursuant to the aforedescribed cutting method, each knife roll set is mounted on an independent sub-frame that is transversely adjustable relative to the progressive process flow direction of a blank series. The cutting knives secured to each knife roll of a set are never disturbed after initial mounting and lapping except for subsequent corrective lapping necessitated by ordinary wear. Accordingly, the entire roll set is transversely adjusted to achieve the desired lateral cutting depth relative to the blank width.

Length of cut and positionment thereof along the blank length is regulated by rotational timing of one cutter roll set relative to another.

To simplify such timing adjustments, the two cutter roll sets respective to laterally opposite side cuts into a blank are synchronously driven from a common drive dividing transmission. Since these cuts will usually be in longitudinal alignment regardless of envelope size or style, it is rarely necessary to adjust the rotational timing therebetween. Nevertheless, closely controlled fine adjustments between common drive cutter roll sets are accomplished by axial displacement of a helical drive gear common to the two roll sets.

For large increment, longitudinal size adjustments, the invention provides a disengagement coupling in each drive line to a commonly driven pair of cutter roll sets. Such means permits the timing of a set pair to be adjusted relative to another set pair without disturbing the relative timing within either set pair.

BRIEF DESCRIPTION OF THE DRAWING

Relative to the drawing wherein like reference characters designate like or similar elements throughout the several figures of the drawing.

DESCRIPTION OF THE PREFERRED EMBODIMENT

Figure 1:
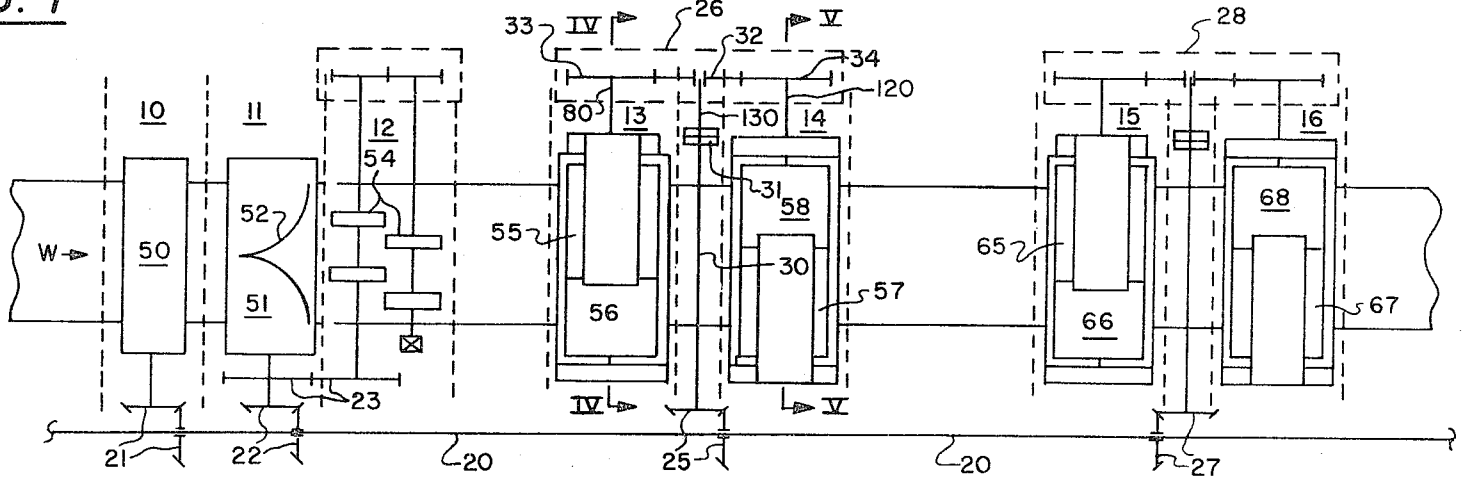
FIG. 1 is a plan schematic illustrating the dominant elements of the invention.
Figure 2:
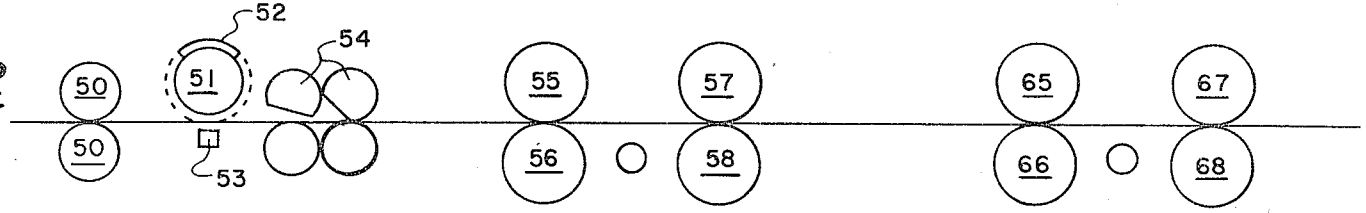
FIG. 2 is an elevational schematic of the invention corresponding to the FIG. 1 plan.
Figure 3:
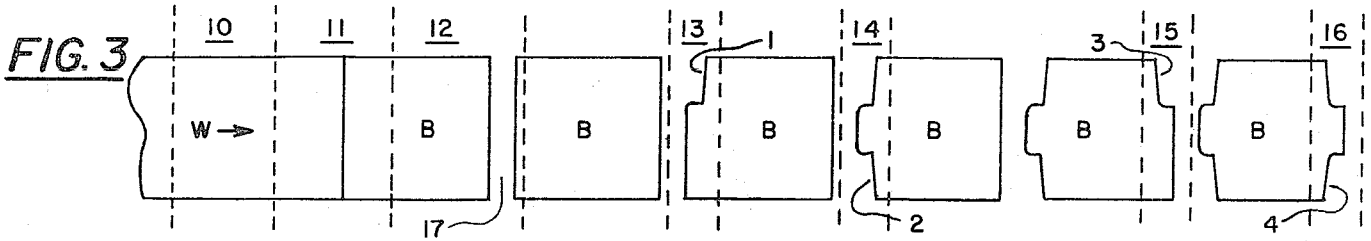
FIG. 3 is a schematic of the progressive process line of the invention.

The collective presentation of FIGS. 1, 2 and 3 relate the material converting process of the invention to the corresponding apparatus.

Regions 10–16, delineated by dashed lines, designate respective process stations whereat a series of operations are performed on the subject work material, web W, to develop a finished envelope blank. Subsequent, not illustrated, process steps apply adhesive and fold the blank to form a finished envelope.

Process station 10 is a web pulling section whereat a rolling traction nip between pulling rolls 50 draws the web W from a continuous supply source such as a supply reel not shown.

From the pulling section, the web W advances into a sheeting section 11 whereat discrete length increments B, characterized as envelope blanks, are transversely severed from the web continuity by a helical knife 52 secured to the surface of rotating knife bed 51. Fixed knife element 53 cooperates with the rotating helical knife 52 to progressively shear the web section confined between the two knives as the two knife edges close together. Such progressive shear cut provides substantially less cutting noise than would result from a straight line snap cut.

In timed coordination with completion of the web cut at sheeter section 11, spacer cams 54 in the blank spacer section 12 converge on the severed blank to accelerate it away from the remaining web leading edge and provide an operating space 17 between the last cut blank B and the previously cut blank. This operating space between adjacent blanks B is substantially maintained as the serial continuum of blanks progresses along the process line.

The first corner cut, 1, on a blank is performed at station 13. Thereafter, the blank advances to station 14 for the second corner cut 2. Corner cuts 3 and 4 are performed at process stations 15 and 16, respectively.

Figure 8:
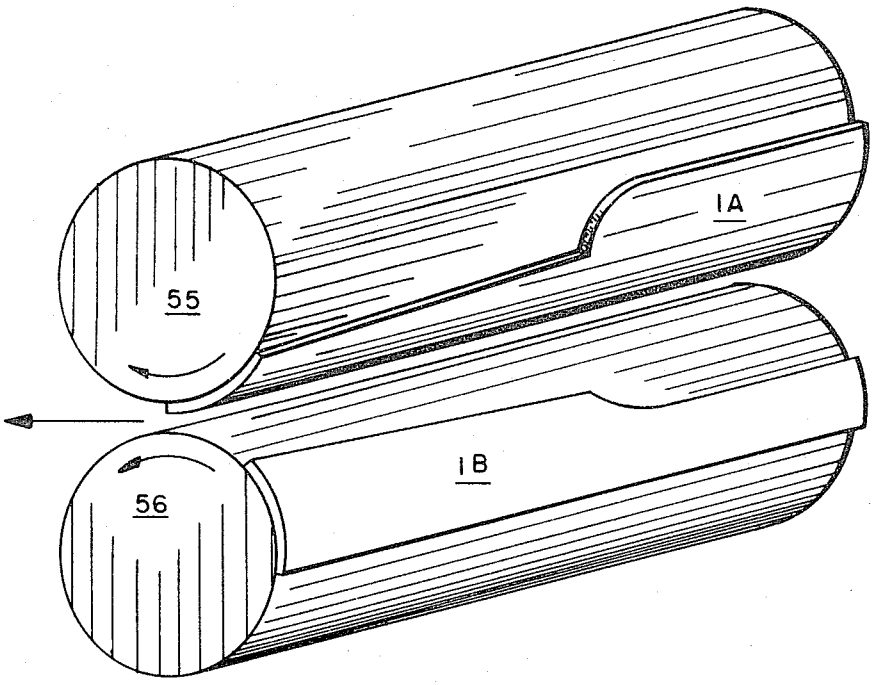
FIG. 8 is an exaggerated detail of a cutter roll set for illustrating hard and soft knife operational cooperation.
Figure 9:
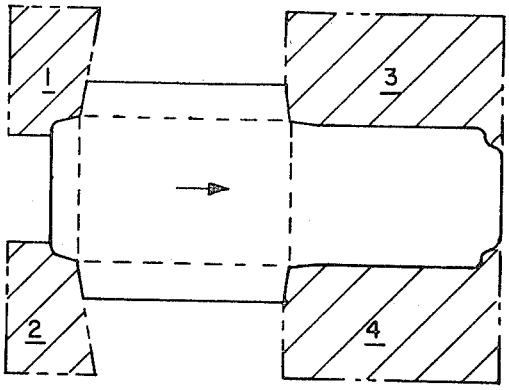
FIG. 9 illustrates a first envelope style available from a single, four cutter combination.
Figure 10:
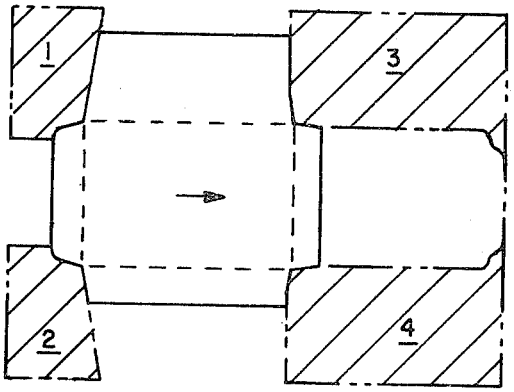
FIG. 10 illustrates a second envelope style available from the same, four cutter combination; and, FIG. 11 illustrates a third envelope style available from the same, four cutter combination.
Figure 11:
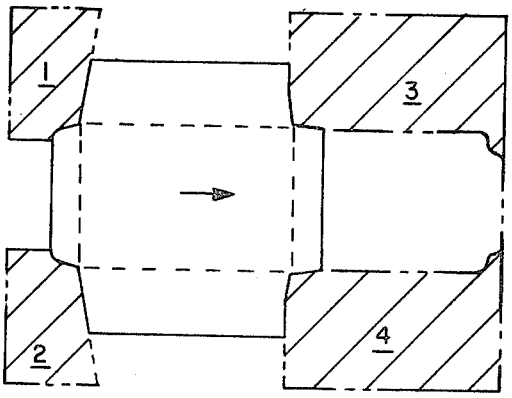

Rolls 55–58 are used in a first cutting drive section for cuts 1 and 2 whereas rolls 65–68 are used in a second cutting drive section for cuts 3 and 4. The several rolls are operated in matched pairs 55–56, 57–58, 65–66 and 67–68 for each of the respective corner cuts. Each roll of a pair beds a respective element of a matched knife set including a "soft" knife 1A and a "hard" knife 1B as is shown by FIG. 8. Once a knife is secured to a respective bed roll, there is no normal or product need to remove it. Different product styles are provided by lateral adjustment of a knife set as may be noted by comparing the cutting profiles respective to FIGS. 10 and 11. Rotational timing of a knife set determines the length of cut as noted by comparing cuts 3 and 4 of FIG. 9 to cuts 3 and 4 of FIG. 10.

A common drive line 20 shown by FIG. 1, provides a common rotational reference period for all rotational elements of the machine. Transmissions 21, 22, 25 and 27 schematically illustrate more complex gear clusters whereby desired speed ratios may be selectively changed. For example, the length of a blank B severed from the web W is determined by the length of material advanced by the pulling rolls 50 under the sheeter roll 51 during a one revolution interim of the sheeter roll. Accordingly, the relative gear ratios of transmissions 21 and 22 determine the blank length and are therefore adjustable. Since the function of spacer cams 54 is unalterably coordinated to the completion of a blank cut, gear set 23 between the sheeter roll 51 drive and the spacer cam 54 drive need not be changeable.

Critical to a complete understanding of the invention is that the present machine provides a traveling series of space increments having a uniform length or periodic interim which is the same as the rotational period of each corner cutting knife set 55–56, 57–58, etc. This characteristic is coupled with the machine capacity to adjust the timed meshing of a cutting knife set to any desired point or moment within the uniform length or interim without disturbing the knife elements, per se, which have a carefully matched and lapped relative cutting profile, so that the cut of a given knife set occurs at the exact same position on each successive blank. Although the uniform traveling space may be filled with actual blank material, filling is not required. An actual blank length may be less (but never greater) than a space length.

Figure 4:
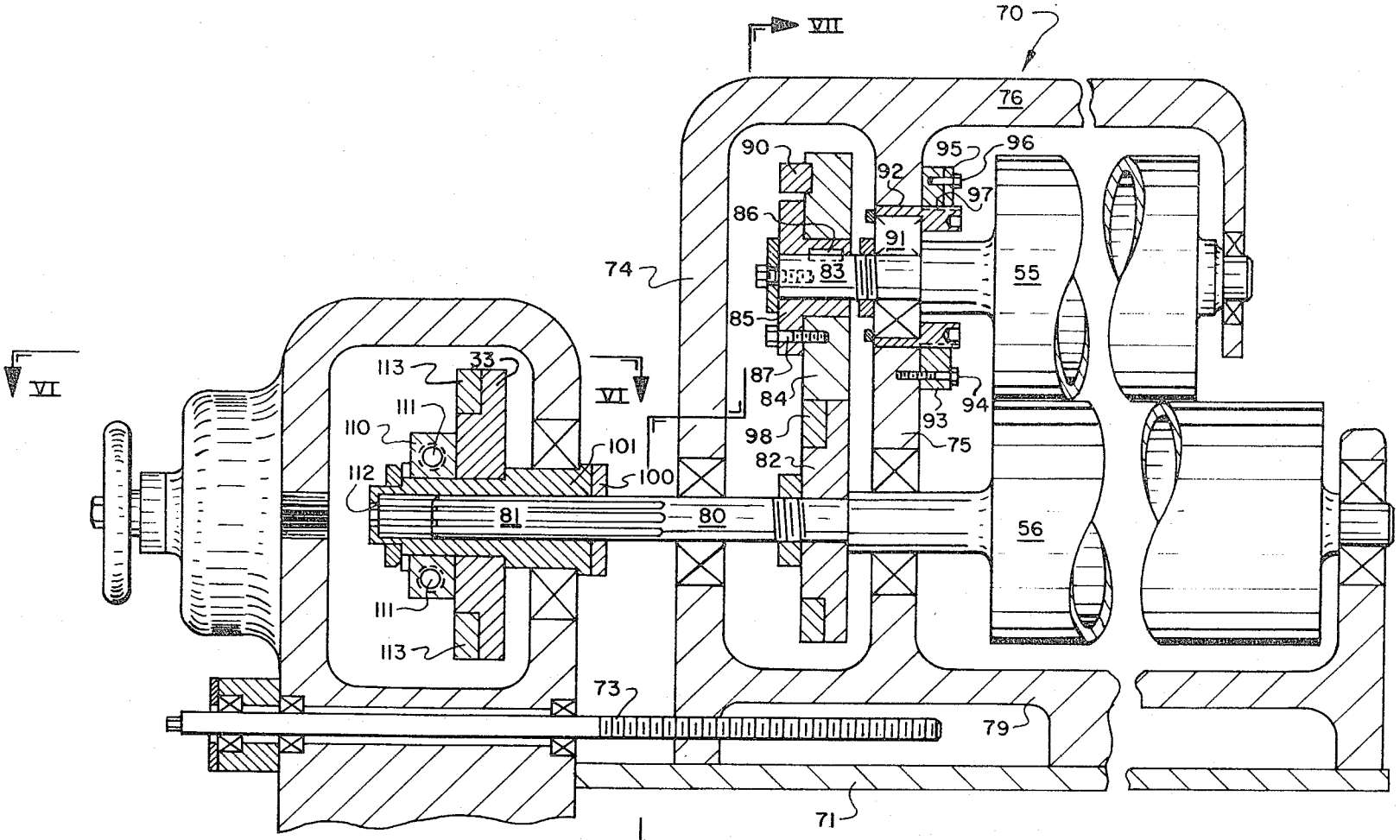
FIG.4 is a sectional elevation along one cutter roll set of a commonly driven pair.
Figure 5:
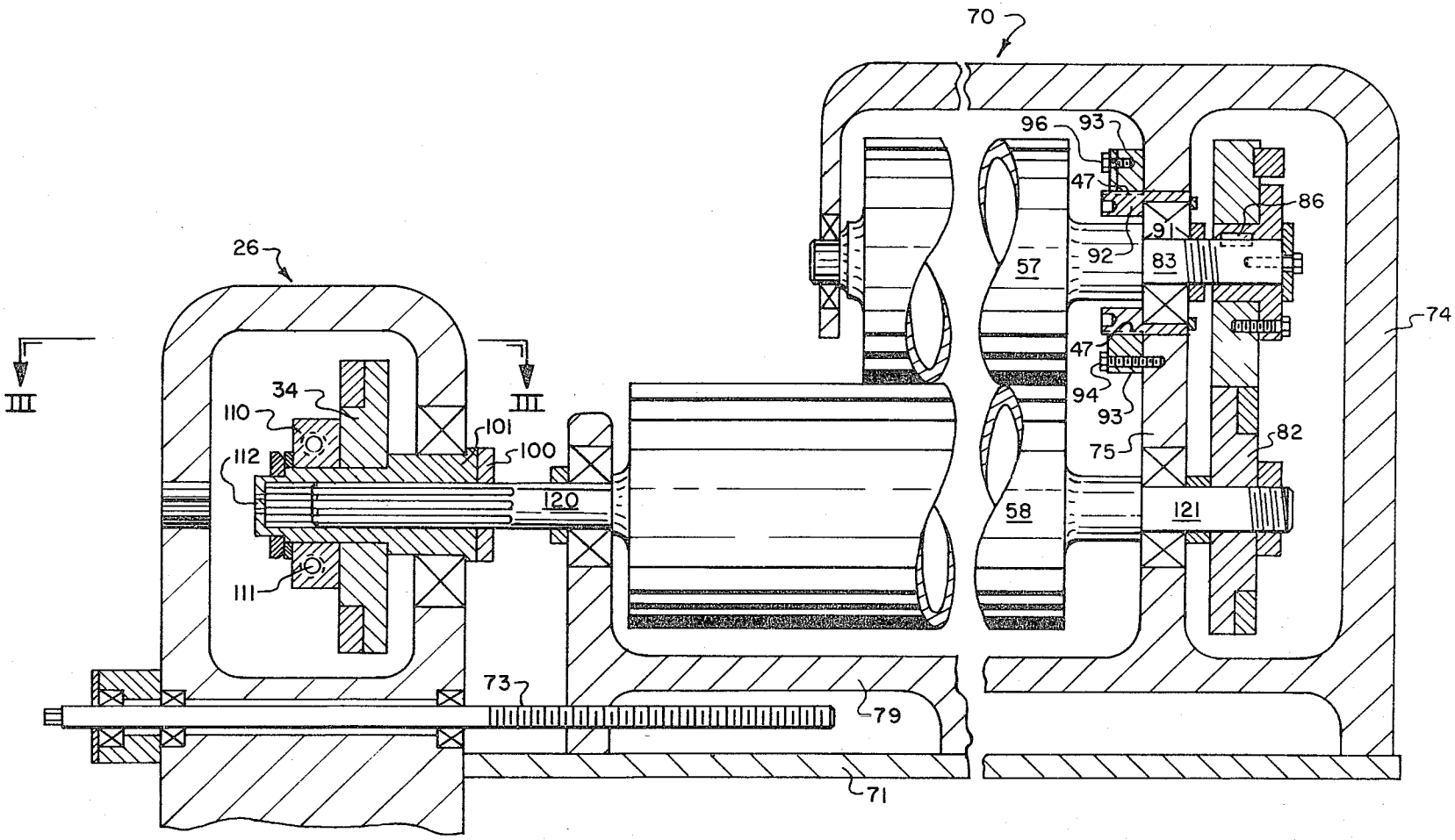
FIG. 5 is a sectional elevation along the other cutter roll set of a commonly driven pair.

To achieve these capacities, the present invention provides an independent frame unit for each cutting knife set 55–56, 57–58, etc. The frame unit design for knife set 55–56 shown by FIG. 4 is identical to the frame for knife set 65–66. Similarly, the frame unit design for knife set 57–58 shown by FIG. 5 is identical to the frame unit for knife set 67–68.

Figure 7:
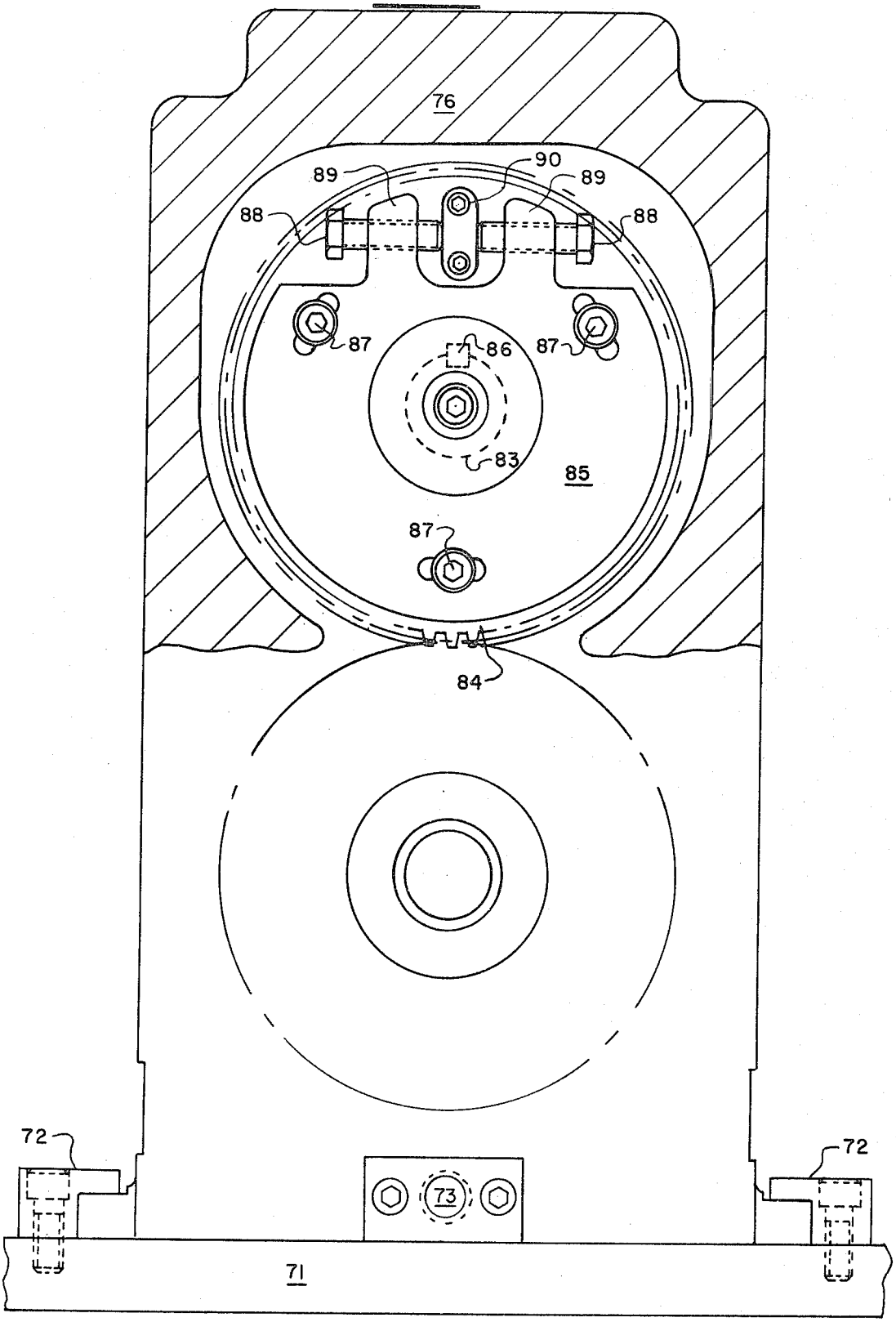
FIG. 7 is a partial sectional end elevation of a drive transfer transmission between respective rolls of a cutter set.

Relative to the frame unit for knife set 55–56 shown by FIG. 4, there is provided a bed plate slideably confined within a transverse guide way 71 on the primary machine frame. Dogs 72 (FIG. 7) secured to the guide way 71 laterally confine the independent frame unit in transverse alignment to the blank traveling direction. An acme thread screw 73 secured axially relative to the primary machine frame provides transverse adjustment of the frame unit position by manual rotation.

Transfer case housing webs 74 and 75 provide structural support for a cantilever bearing beam 76 relative to the bed plate 79. Stub shaft 80 has a splined torque connection 81 with divider gear 33 to accommodate rotary power transmission throughout the transverse adjustment range of the independent frame unit. Stub shaft 80 also has a rotative drive connection to knife roll 56 and to transfer gear 82.

Soft knife roll 55 is driven by stub shaft 83 and transfer gear 84. Between the shaft 83 and gear 84 is an intermediate, flanged collar 85. A key 86 non-rotatively secures the collar 85 to the shaft 83 whereas several flange screws 87 secure the collar to the transfer gear 84. Through slots in the collar flange receiving the screws 87 permit a limited coaxial rotational adjustment between the knife roll 55 and the transfer gear 84 for final fit and wear adjustments of the soft knife profile relative to the corresponding hard knife. Such minute rotary adjustments are controlled by means of a pair of push-pull screws 88 (FIG. 7) threaded through ear portions 89 of the flange 85 and bearing against a boss 90 secured to the transfer gear 84.

For axial adjustment of the knife profile, the entire knife roll 55 is shifted axially with its respective outboard bearing 91 which is axially caged within a threaded sleeve 92. Threaded external ring 93 is secured by machine screws 94 to the housing web 75. Subsequent to internal threading of the ring 93, an arc portion 95 is slotted. Machine screws 96 threaded into the rigidly mounted body of the ring 93 serve to bind the threads 97 between the bearing cage sleeve 92 and the rigidly securing ring 93 to prevent adjustment drift due to operational vibration. Desired axial adjustments of knife roll 55 are obtained by rotating the sleeve 92 in an appropriate direction thereby advancing the sleeve 92 along with the bearing 91, shaft 83 and knife roll 55.

Precise meshing of the soft and hard knife cutting profile is further maintained by eliminating all gear lash between transfer gears 83 and 84. An annular tooth profile portion 98 of the transfer gear 82 is separable from the hub portion of the gear. The other portion of the tooth profile is integral with the hub of gear 82. By concentric counter-rotation of the independent annular tooth portion 98 relative to the hub portion of the tooth profile, the effective tooth thickness is increased to eliminate any free space or lash between the teeth respective to gears 82 and 84. Such zero-lash adjustments are made by an eccentric pin device and maintained by clamping machine screws not shown.

It will be seen that the synchronous rotational timing relationship between the transfer gears 82 and 83 determine the timed meshing of the hard and soft knife cutting elements 1A and 1B. Once set, there is little need to disturb this relationship except for re-lapping the cutting elements due to wear.

Anti-backlash ring 100 functions similarly to the foregoing description to eliminate lash between the spline 81 of stub shaft 80 and the internally splined drive collar 101 which transfers torque from the driven gear 33 to the shaft 80.

Driven gear 33 is releasably clamped to drive collar 101 by means of a hub clamp 110 secured to a hub half that is identical to the hub clamp but structurally integral with the body of gear 33. The hub clamp 110 is structurally free of the gear and gear hub except for clamping screws 111. When screws 111 are loose, drive collar 101, stub shaft 80 and knife roll set 55–56 may be rotated coaxially independent of divider gear 33. A socket 112 is provided to facilitate such manual independent knife roll rotation for the purpose of changing the exact cutting moment of corresponding blade meshing relative to the length of blank B. In other words, the cut timing of knife roll set 55–56 may be changed relative to the cut time of any other set in the machine without disturbing the mesh profile between mating soft and hard knives secured to the roll set.

Tightening the screws 111 will secure the gear 33 coaxial angular position on the collar 101 for running at the newly adjusted cut time.

The anti-backlash ring 113 accomplishes the same end for the gear couple between driven gear 33 and the dividing gear 32 as does anti-backlash ring 98 for the gear couple 82–84.

Referring next to FIG. 5, it will be immediately noted that the independent frame unit 70 for the knife roll set 57–58 is identical to the frame unit aforedescribed for roll set 55–56 except for the fact that machine mounting relative to the drive divider transmission 26 is reversed. This expendient requires only that the roll 58 end shafts 120 and 121 be different from the respective end shafts for hard knife roll 56.

In view of the near identity of roll set 57–58 to that of 55–56, it should not be necessary to again relate the construction and operating details of the drive train components. Consequently, the same reference numbers have been assigned to FIG. 5 as are used for corresponding elements in FIG. 4.

Although the axial length of the soft knife rolls 55, 57, 65, 67 need only be approximately half the maximum web width, it is expendient to continue the section of the hard knife rolls 56, 58, 66 and 68 completely across the machine as a continuous, full width support for the blank B conveyance line along the machine.

Figure 6:
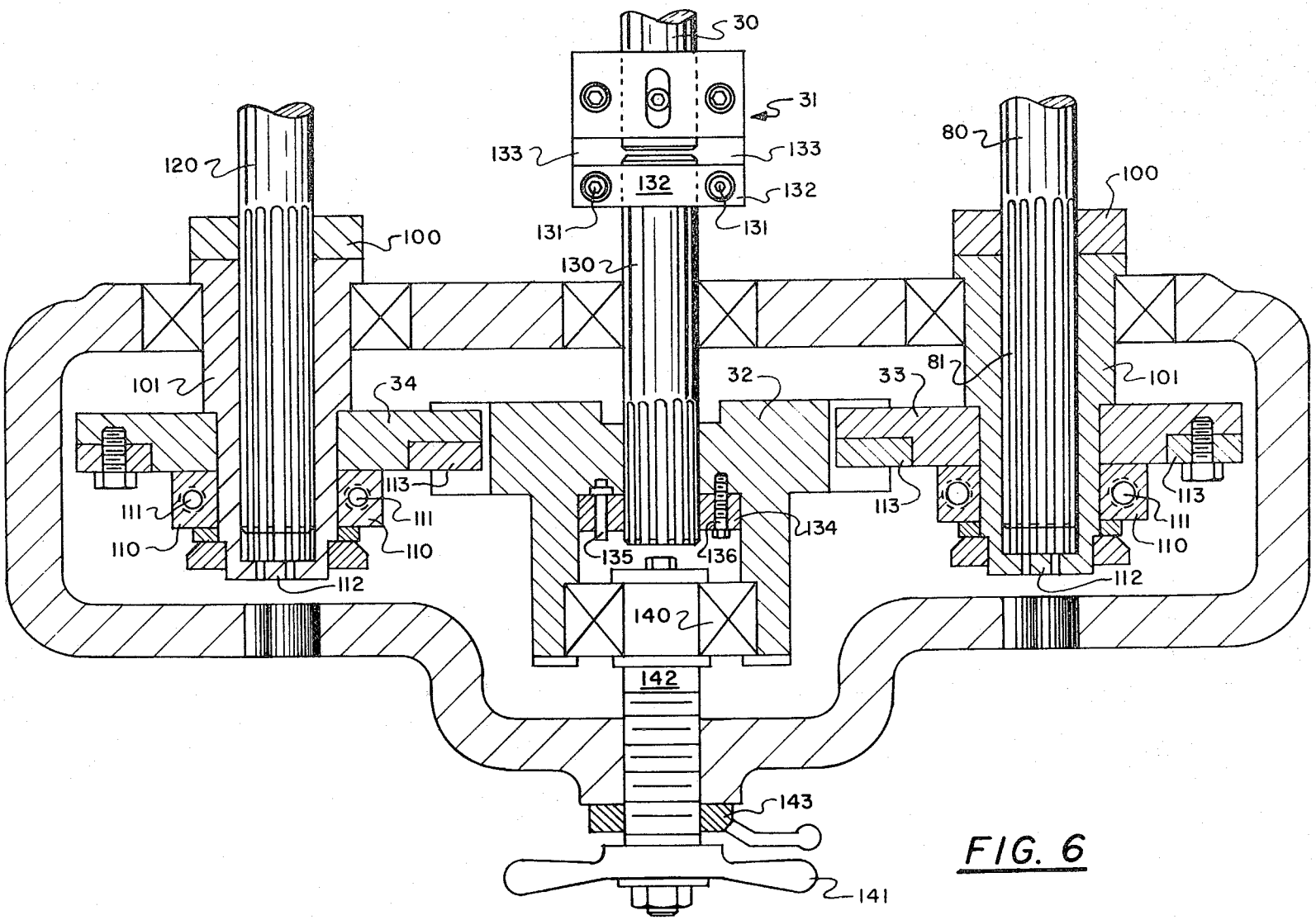
FIG. 6 is a sectional plan of a cutter roll drive dividing transmission.

FIG. 6 illustrates the drive divider 26 for the first cutter section comprising knife roll sets 55–56 and 57–58. Design and construction details for the second cutter section drive divider 28 are identical to those of divider 26.

Input power carried by primary drive shaft 30 is transferred to a splined stub shaft 130 by means of a clamp coupling 31 which is pinned against rotation relative to shaft 30. Stub shaft 130 may rotate coaxial independent of drive shaft 30 when the clamping screws 131 are loosened to relieve cap 132 from clamping pressure on the stub shaft 130 against the coupling body 133. In such a manner, an entire cutter section may be retimed relative to the other cutter section without disturbing the timed coordination between knife roll sets within either cutter section maintained by transfer gears 82 and 84.

Divider drive gear 32 is mounted on the splined end of stub shaft 130 with an anti-backlash ring 134. Eccentric 135 provides relative rotational adjustment of the ring and screws 136 clamp the ring in the desired position.

It is important to note that all of divider gears 32, 33 and 34 are of helical tooth form. Consequently, there is an axial twist to the tooth development. This characteristic is exploited to achieve minute, coordinated timing adjustments of an entire cutter section by displacing the drive gear 32 axially within the meshing plane of divider gears 33 and 34. Such axial displacement is accomplished by means of a push-pull bearing mount for the gear 32. The bearing 140 is axially secured to the distal end of a threaded shaft 142 extended through the transmission housing. A hand wheel 141 facilitates rotation of the shaft 142 and thread clamping ring 143 binds the threads at a desired position to prevent vibrational drift of the threaded adjustment.

In review of the disclosure, the present invention teaches an envelope fabrication process which accommodates several different, but compatible, envelope styles and a range of sizes for each style. The first step in practice of the invention is designing the tab cuts for all of the several envelope styles to share a common profile whereby the same rotary knife sets are used on all styles: only the depth or symmetry of cut relative to the body of the envelope face need be changed.

In the preferred embodiment, four rotary knife sets are provided in a progressive process line; a knife set for each corner of a rectangular blank. Each knife set is mounted in an independent subframe that may be positionally adjusted transversely of the process line.

The longitudinal location of a blank corner cut along a blank length is determined by the rotational timing of the knife set making the respective cut. The blank moves at a constant velocity between the respective rolls of a knife set. Roll timing refers to that point along the blank length as it moves between the rolls that the knife dies mesh together to shear the desired cut.

To simplify the roll timing task, knife roll sets are driven in pairs: a pair for the two top corner cuts 1 and 2 of a blank and another pair for the two bottom corner cuts 3 and 4.

All knife roll drive is initially derived from a single line shaft 20 which provides a common rotational reference period. From the line shaft 20, an independent drive shaft is provided for each pair of knife roll sets. Each independent drive shaft is provided with a coupling of a type that will allow drive connection at any coaxial relative angle between the drive input and output sides of the coupling. By such means, either pair of knife sets may be retimed relative to timing between knife roll sets respective to either pair.

In addition, the rotational drive train of any knife roll set may by rotatively decoupled from the companion knife roll set of the same pair without disturbing the knife die timing between respective rolls of either set.

Moreover, means are provided for closely controlled, micrometer adjustment of one roll of a knife set relative to the other for the purpose of knife lap adjustments.

Having fully described our invention obvious alternatives and mechanical equivalents to certain devices and techniques utilized in the preferred embodiment will readily occur to those of ordinary skill in the art. As our invention, however,

We claim:

1. A method of converting rectangular sheet material blanks to envelope configuration using rotary cutter rolls, said method comprising the steps of:

A. Cutting a first series of first proportioned rectangular sheets from a continuous web supply;

B. Serially transporting said first rectangular sheets along a laterally fixed feed path;

C. Cutting opposite side top end corners of said first rectangular sheets with respective first and second cutting knives to form a top flap and top edges of symmetric side flaps;

D. Cutting opposite side bottom end corners of said first rectangular sheet with respective third and fourth cutting knives to form bottom edges of said symmetric side flaps and an integral bottom and back flap which, when folded, extends from the bottom end of an envelope to the top end;

E. Changing the lateral cutting position of said cutting knives relative to said fixed feed path, said first and third knives on one side of said feed path and said second and fourth knives on the other side thereof;

F. Cutting a second series of second proportioned rectangular sheets from a continuous web supply;

G. Cutting opposite side top end corners of said second rectangular sheets with said respective first and second cutting knives to form a top flap and top edges of asymmetric side flaps, one of said side flaps forming an integral back flap which, when folded, extends across the back of an envelope substantially from side to side; and, H. Cutting opposite side bottom end corners of said second rectangular sheet with said third and fourth cutting knives to form bottom edges of said assymetric side flaps and a bottom flap.

2. A method of cutting the blanks of a multiplicity of envelope sizes and styles with a plurality of meshing element rotary cutting dies, each die set comprising male and female die elements secured to the rotating surface of respective rolls in a synchronously driven pair, each male and female element of a die set being rotationally lapped together for a meshing shear cut of a web disposed therebetween, each pair of rolls being independently and laterally positionable relative to a material feed path without disturbing the meshing fit of constituent die elements, each pair of rolls also having independent rotational timing to adjust a cutting interval of each pair within and relative to a cutting interim common to all roll pairs whereby the position of a blank cut made by a respective pair may be adjusted longitudinally of said blank relative to the cut position of other roll pairs, said method comprising the steps of:

A. Cutting a series of rectangular blanks from a continuous web supply;

B. Serially transporting said blanks in aligned movement along said material feed path;

C. Positioning the trailing edge of each blank along said feed path to correspond with the starting moment of said common cutting interim;

D. Timing the cutting interval of first and second roll pairs positioned on opposite sides of said feed path, said timing being measured relative to said starting moment to cut opposite side corners on one end of each blank for forming a top end tab and top edges of opposite side tabs;

E. Timing the cutting interval of third and fourth roll pairs positioned on opposite sides of said feed path, said timing being measured relative to said starting moment to cut opposite side corners on the other end of each blank for forming a bottom end tab and bottom edges of said opposite side tabs;

F. Shaping the cutting dies of said first and second roll pairs to form an envelope back face as an integral continuation of said side tabs; and, G. Shaping the cutting dies of said third and fourth roll pairs to form an envelope back face as an integral continuation of said bottom tab.

3. A method as described by claim 2 wherein the blank cut positions of dies secured to said first and second roll pairs and the blank cut positions of said third and fourth roll pairs are, respectively, located laterally symmetric relative to said feed path and said third and fourth roll pairs are timed to cut a back face tab from the leading edge of a blank to a bottom edge fold-line thereof whereby said back face tab is an integral extension of said bottom end tab.

4. A method as described by claim 2 wherein the blank cut positions of dies secured to said first and second roll pairs and the blank cut positions of said third and fourth roll pairs are, respectively, located laterally symmetric relative to said feed path and at a sufficient cutting depth into a blank whereby an envelope back face is formed between opposite side edge fold-line by the central overlapping of integrally extended side tabs.

5. A method as described by claim 2 wherein the blank cut positions of dies secured to said first and second roll pairs and the blank cut positions of said third and fourth roll pairs are, respectively, located laterally asymmetric relative to said feed path with said first and third roll pairs set at a sufficient cutting depth into a blank whereby an envelope back face is formed as an integral extension of the respective side tab.

6. A method as described by claim 2 wherein the cut timing of said first and second roll sets is adjusted simultaneously relative to said starting moment for accommodation of a change in the cut length of blanks supplied along said feed path.

7. A method as described by claim 2 wherein the cut timing of said third and fourth roll sets is adjusted simultaneously relative to said starting moment for accommodation of a change in the cut length of bottom tabs.

* * * * *